United States Patent [19]

Watanabe et al.

[11] 4,412,550

[45] Nov. 1, 1983

[54] COIN ACCUMULATOR ASSEMBLY

[75] Inventors: Kenkichi Watanabe; Setsuo Hata, both of Tokyo, Japan

[73] Assignee: Laurel Bank Machine Co., Ltd., Tokyo, Japan

[21] Appl. No.: 261,573

[22] Filed: May 7, 1981

[30] Foreign Application Priority Data

May 8, 1980 [JP] Japan ..... 55-61162

[51] Int. Cl.[3] ..... G07D 9/06

[52] U.S. Cl. ..... 133/8 A; 414/100

[58] Field of Search ..... 133/8 A, 8 D, 8 R, 1 A; 53/254, 212; 414/98, 100, 45, 48

[56] References Cited

U.S. PATENT DOCUMENTS 2,487,164 11/1949 Miconi ..... 133/8 R 3,542,214 11/1970 Helms ..... 414/98 X 4,354,787 10/1982 Gensike et al. ..... 414/100 X

*Primary Examiner*—Stanley H. Tollberg

*Attorney, Agent, or Firm*—Fleit, Jacobson, Cohn & Price

[57] ABSTRACT

A coin accumulator assembly for use in a coin wrapping machine is provided. The coin accumulator assembly comprises a coin accumulator tube, a shutter movably inserted into the coin accumulator tube for supporting coins stacked in the tube until a predetermined number of coins is accumulated and for opening to pass coins for a further treatment when the predetermined number of coins is accumulated in the tube, and a system for stepwisely lowering the shutter during the coin counting and accumulating operation. The system for effecting stepwise lowering of the shutter includes a support member for supporting the shutter and having a threaded hole, a screw shaft thrusting through said threaded hole of the support member, a reversible motor for rotating the screw shaft, and a guide rod to be slidably engaged with the support member for preventing the support member from being rotated but for guiding the same in the downward or upward direction when the screw shaft is rotated. A modified system including a rack-and-pinion unit may be used in place of the aforementioned system. A further modified system including a swingable arm for lowering or raising the support member is also disclosed herein. Further disclosed are the control systems for controlling the coin accumulator assembly in accordance with the pre-set control sequence.

4 Claims, 15 Drawing Figures

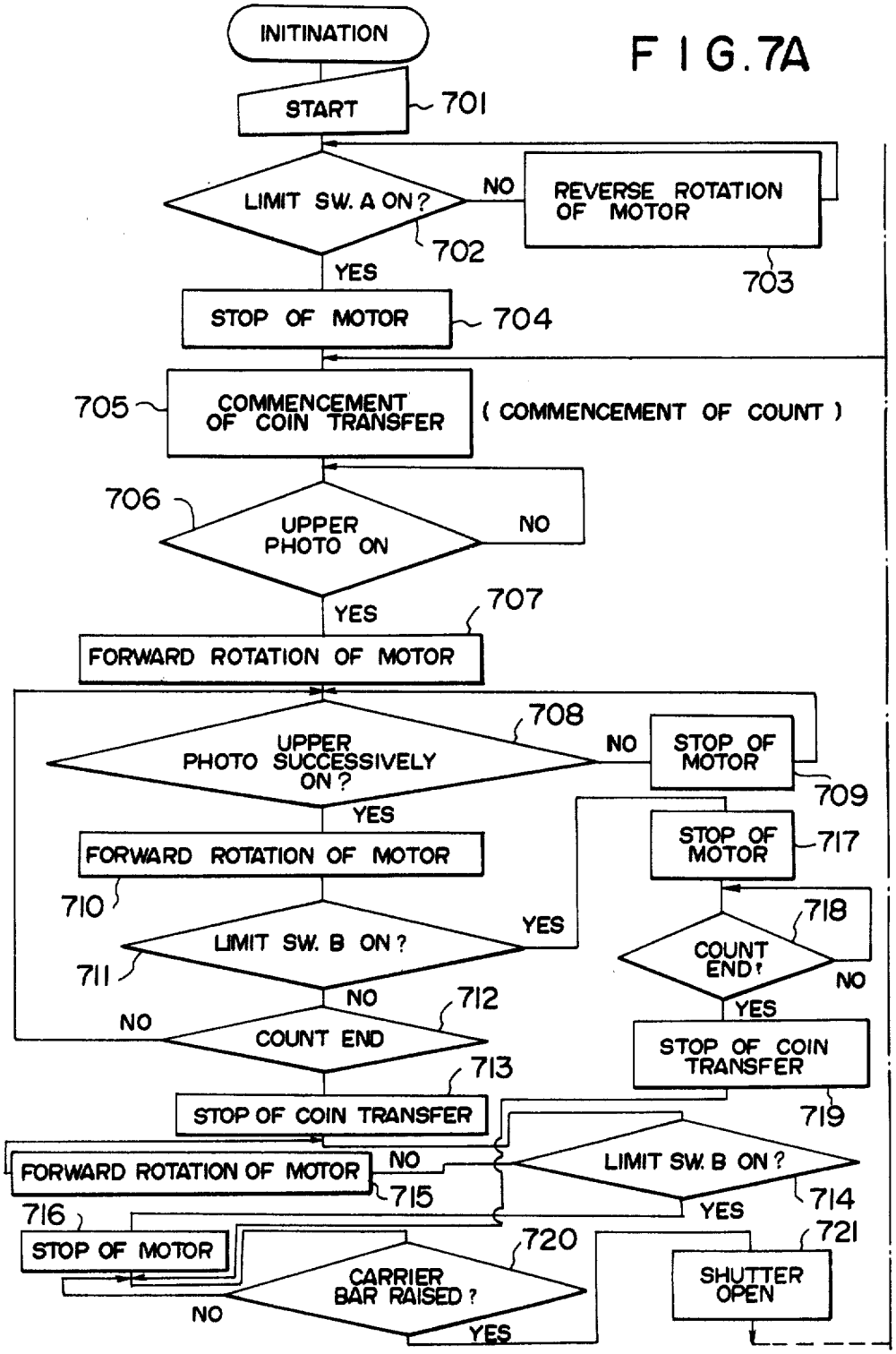
FIG.7A
INITINATION
START
701
LIMIT SW. A ON?
NO
REVERSE ROTATION OF MOTOR
702
703
YES
STOP OF MOTOR
704
705
COMMENCEMENT OF COIN TRANSFER
( COMMENCEMENT OF COUNT )
706
UPPER PHOTO ON
NO
YES
707
FORWARD ROTATION OF MOTOR
708
UPPER PHOTO SUCCESSIVELY ON?
NO
STOP OF MOTOR
709
YES
FORWARD ROTATION OF MOTOR
STOP OF MOTOR
717
710
718
LIMIT SW. B ON?
YES
COUNT END?
711
NO
NO
712
YES
NO
COUNT END
STOP OF COIN TRANSFER
713
STOP OF COIN TRANSFER
719
FORWARD ROTATION OF MOTOR
NO
LIMIT SW. B ON?
715
714
YES
716
STOP OF MOTOR
720
721
CARRIER BAR RAISED?
SHUTTER OPEN
NO
YES

| FIG.10A | FIG.10B |
|---|---|

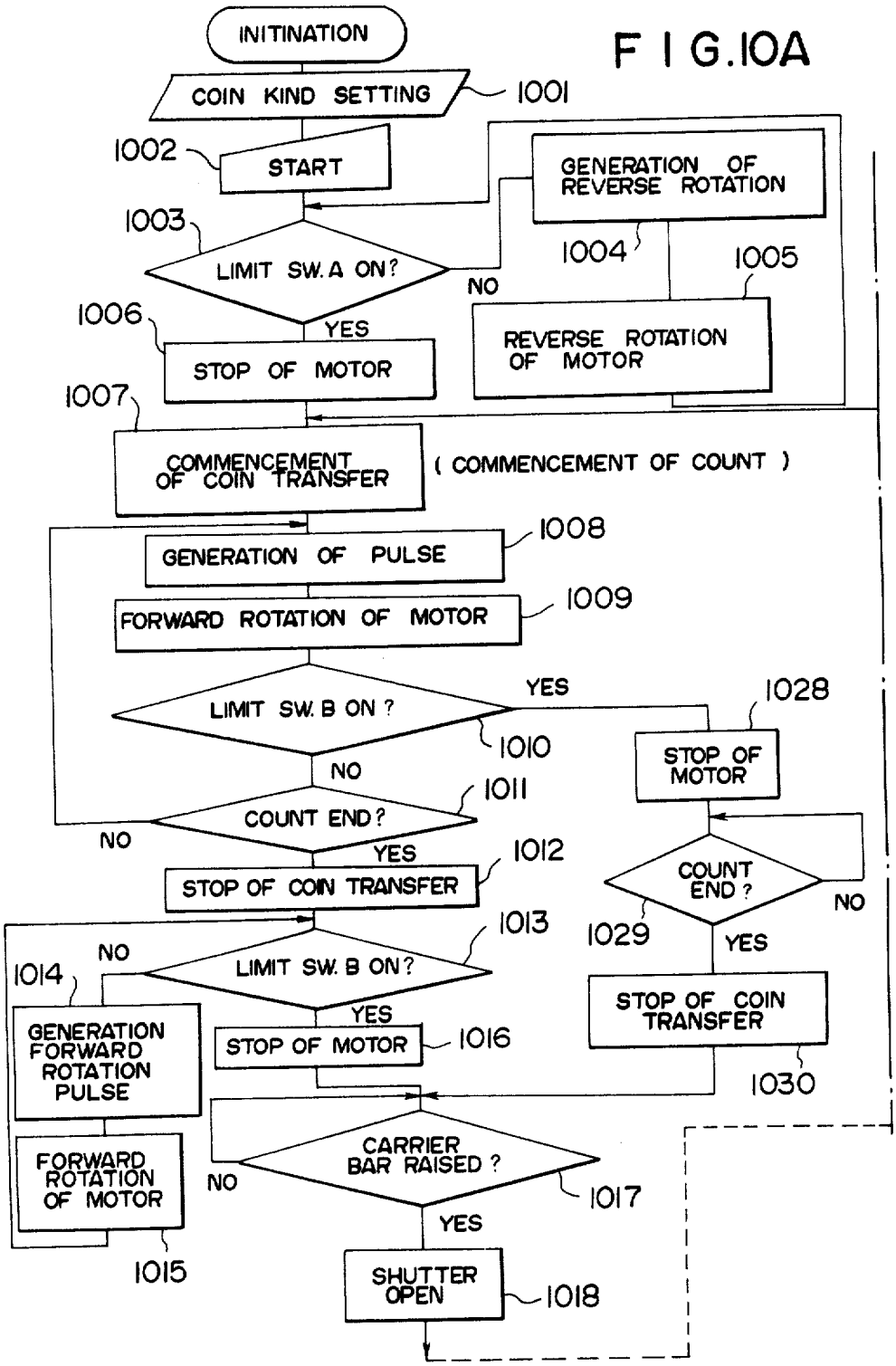
FIG.10A
INITINATION
COIN KIND SETTING
1001
1002
START
GENERATION OF REVERSE ROTATION
1003
LIMIT SW. A ON?
NO
1004
1005
YES
1006
STOP OF MOTOR
REVERSE ROTATION OF MOTOR
1007
COMMENCEMENT OF COIN TRANSFER
( COMMENCEMENT OF COUNT )
GENERATION OF PULSE
1008
FORWARD ROTATION OF MOTOR
1009
LIMIT SW. B ON ?
YES
1028
1010
STOP OF MOTOR
NO
1011
COUNT END?
NO
YES
1012
STOP OF COIN TRANSFER
COUNT END ?
NO
1029
YES
1013
NO
1014
LIMIT SW. B ON?
YES
GENERATION FORWARD ROTATION PULSE
STOP OF MOTOR
1016
STOP OF COIN TRANSFER
1030
FORWARD ROTATION OF MOTOR
CARRIER BAR RAISED ?
NO
1017
YES
1015
SHUTTER OPEN
1018

COIN ACCUMULATOR ASSEMBLY

BACKGROUND OF THE INVENTION

1. Field of the Invention

The present invention relates to a coin wrapping machine, and particularly to a coin accumulator assembly for use in the coin wrapping machine.

In the typical coin wrapping machine, coins are fed on a rotary disk and then guided to a coin guide passage one by one. While being passed through the coin guide passage, the coins are counted. The coins, after being counted, are conveyed by a conveyor belt to a coin accumulator tube through a chute. The coin accumulator tube may have a height for accommodating a predetermined number of thickest coins and means for adjusting the operational height adapted to receive a pre-set number of coins. Alternatively, a coin accumulator tube which is adapted to receive a predetermined number of coins of pre-set species or kind is selected from a group of coin accumulator tubes each being adapted to accumulate coins of individual species, and assembled in operational position. In either case, coins are stacked on a shutter plate provided at the bottom of the coin accumulator tube to form a stack of coins. After the predetermined number of coins has been accumulated in the tube, the shutter plate is opened and the stacked coins are discharged from the tube and carried by a carrier bar positioned just beneath the shutter plate to be moved to a wrapping station.

2. Prior Art

In the conventional assembly, since no means for effecting stepwise accumulation of coins is not associated in the coin accumulator tube, coins fed from the chute to the accumulator tube are allowed to fall down in the vertical direction under the action of gravitational force. During this falling movement, each coins is not always maintained horizontally but is swayed or inclined randomly. Partly by this random movement and partly by an irregular bounding action, there is a possibility for some of the coins to be stacked in disorder, for instance, any one of the coins being overlaid on the preceding coin in an inclined condition. If such a disorder occurs, the coin stack cannot be subjected to the subsequent wrapping operation and must be removed from the wrapping machine, leading to reduction in performance efficiency of the machine. Moreover, some means for detecting the occurrence of such disorder must be provided.

SUMMARY AND OBJECT OF THE INVENTION

The primary object of the invention is to provide a coin accumulator tube provided with means for effecting stepwise accumulation of coins.

According to one embodiment of the invention, said means for effecting stepwise accumulation of coins includes a support member for supporting the shutter and having a threaded hole, a screw shaft thrusted through the threaded hole, a driving system including a reversible motor for rotating the screw shaft, and a guide rod to be slidably engaged with the support member for preventing the latter from being rotated but for guiding the same in the downward direction when the screw shaft is rotated by the driving system. According to further embodiments of the invention, the aforementioned combination of the screw shaft, the threaded hole and the guide bar may be replaced by a rack-and-pinion system or a combination of a swingable arm and a cam plate associated with suitable driving means.

A further object of the invention is to provide a system for controlling the coin accumulator assembly in accordance with a suitable sequential control program.

DESCRIPTION OF THE DRAWINGS

The features and advantages of the present invention will become apparent from the following detailed description of the presently preferred embodiments of the invention with reference to the drawings, in which.

DESCRIPTION OF PREFERRED EMBODIMENTS

Figure 1:
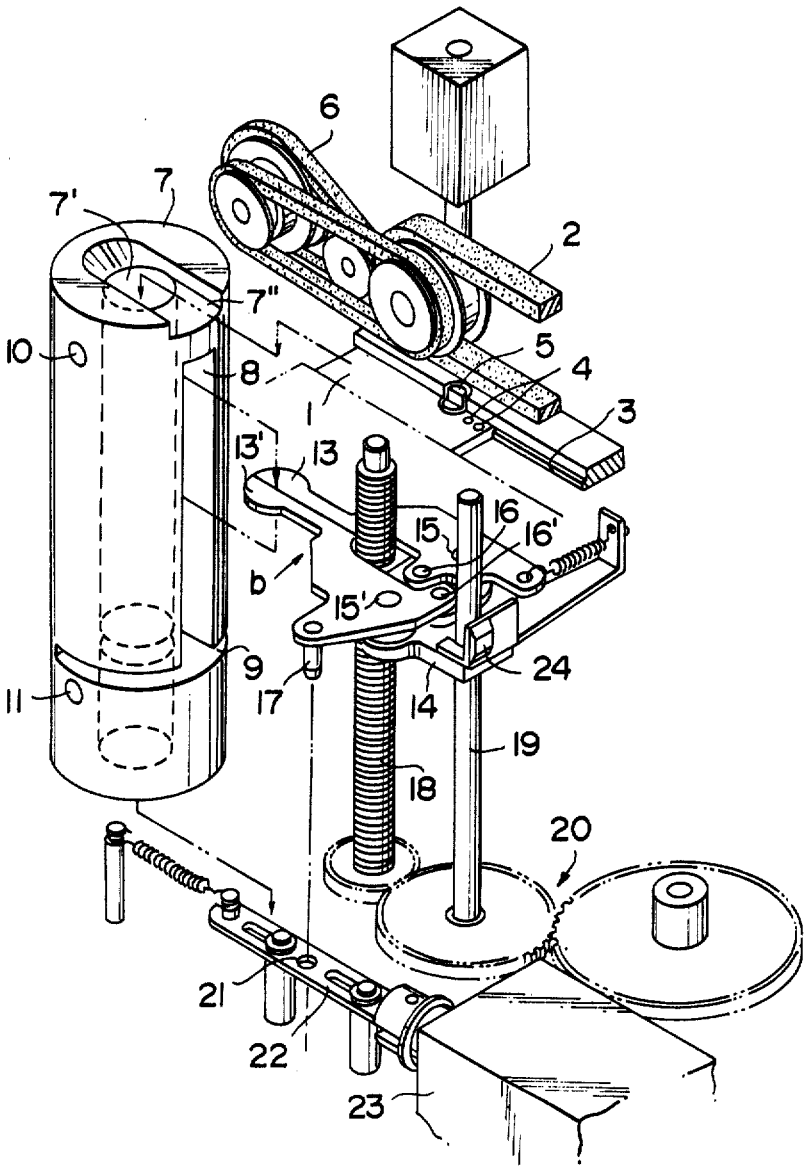
FIG. 1 is an exploded view showing main portions of an embodiment of the invention.
Figure 2:
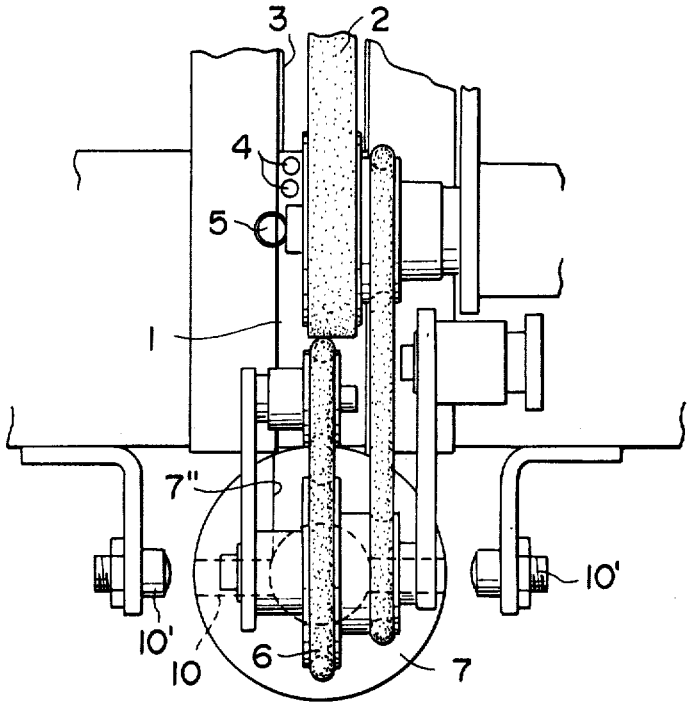
FIG. 2 is a plan view showing a portion of the coin guide passage and the coin accumulator tube according to the invention.

The present invention will now be described in detail with reference to the appended drawings showing preferred embodiments of the invention.

Firstly referring to FIGS. 1 to 4, coins are successively fed to a coin guide passage 1 and conveyed through the passage by a conveyor belt 2. The coin guide passage 1 is provided with means for rejecting coins of different species, for example a coin rejection hole or slot 3, sensors for detecting the passage of coins comprising photoelectric elements 4 and 4, a stopper 5 for stopping passage of coins after a pre-set number of coins has been passed to a coin accumulator tube 7 and adapted to rotate to a normal position for allowing the coins to pass in response to a signal for instructing to start the next cycle operation, and another conveyer belt 6 moving at a relatively higher speed than the conveyor belt 2 so as to increase the gaps between adjacent coins.

A coin accumulator tube, designated by numeral 7, has a hollow cavity 7' in which coins are accumulated. The diameter of the cavity 7' may be varied in accordance with the diameter of coins to be accumulated therein, or a coin accumulator tube having a cavity for snugly receiving coins of single species may be selected from a group of accumulator tubes to be assembled in the system. A coin reception recess 7'' is formed on the top of the coin accumulator tube 7. The coin accumulator tube 7 is assembled such that the top face of the coin reception recess 7'' is flush with the guide face of the coin guide passage 1 or positioned at the level slightly lower than the latter. A vertically-extending slit 8 is cut through the peripheral wall of the tube 7, and a circumferential slit 9 is formed at the lower portion of the cylindrical tube 7. A radial through-hole 10 for an upper photoelectric sensor 10' for sensing the height of accumulated coins is provided at the upper portion of the tube 7. Another radial through-hole 11 for a lower photoelectric sensor 11' for detecting the presence of a carrier bar 12 (see FIG. 3) is provided at the lower portion of the tube 7.

A movable shutter mechanism b is associated with the coin accumulator tube 7. The movable shutter mechanism b of this embodiment comprises shutter plates 13 and 13' each having a generally semicircular free end, an elongated stem portion and a generally trapezoidal base portion. In the normal closed position, both shutter plates 13 and 13' engage with each other with their free ends forming a generally circular shutter which is inserted in the cavity of the coin accumulator tube 7 to form the bottom thereof and to support the accumulated coins until a pre-set number of coins is stacked in the tube 7. The base portions of the shutter plates 13 and 13' are pivoted by pins 15 and 15' of a support member 14 and moved by rollers 16 and 16' mounted on lugs of the base portions to open or close the shutter formed by the generally semicircular free ends of the shutter plates 13 and 13'. An operation pin 17 is mounted to another lug of the base portion of the one shutter plate 13'.

The support member 14 has a threaded hole for engaging with a screw shaft 18 and another hole through which a guide rod 19 extends to prevent the support member 14 from rotating. The screw shaft 18 is rotated by a driving system 30 to lower or raise the support member 14.

When the support member 14 is lowered to the lowermost position, the operation pin 17 engages with a hole 21 of an operating lever 22. The operating lever 23 is connected to a solenoid 23.

Figure 3:
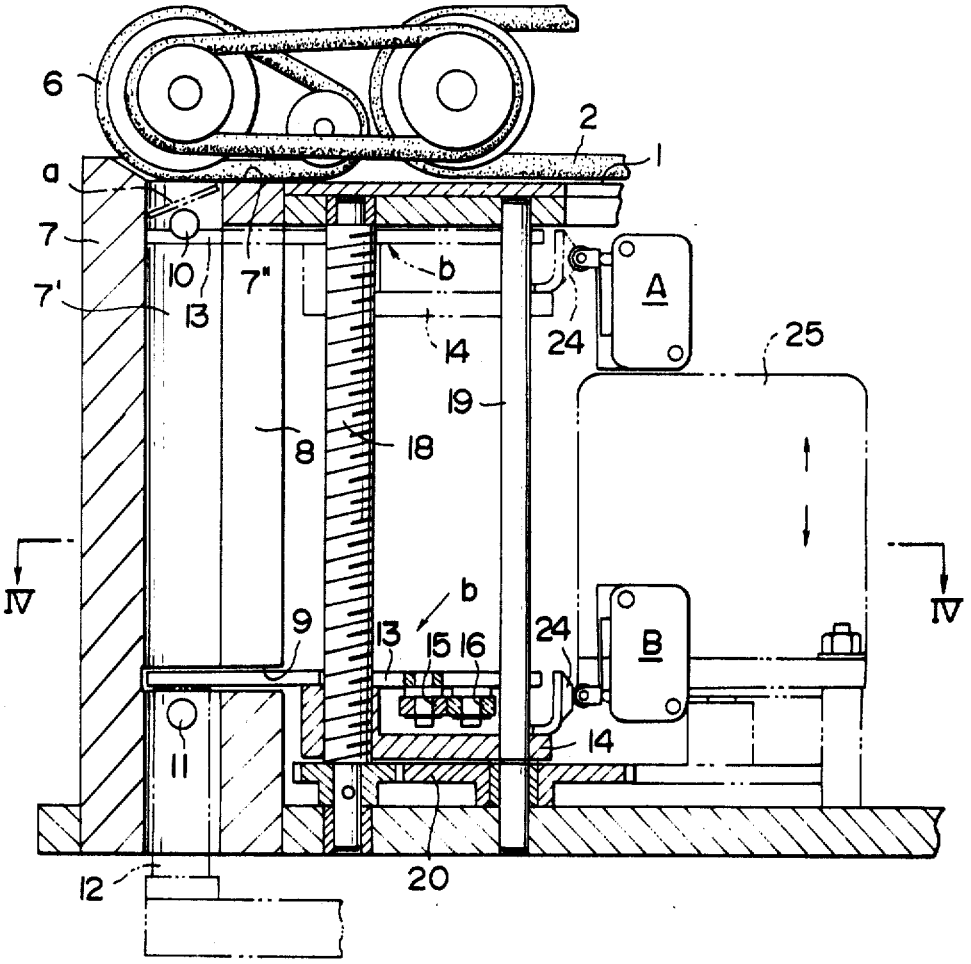
FIG. 3 is a sectional view showing the outline of a coin accumulator tube embodying the invention.
Figure 4:
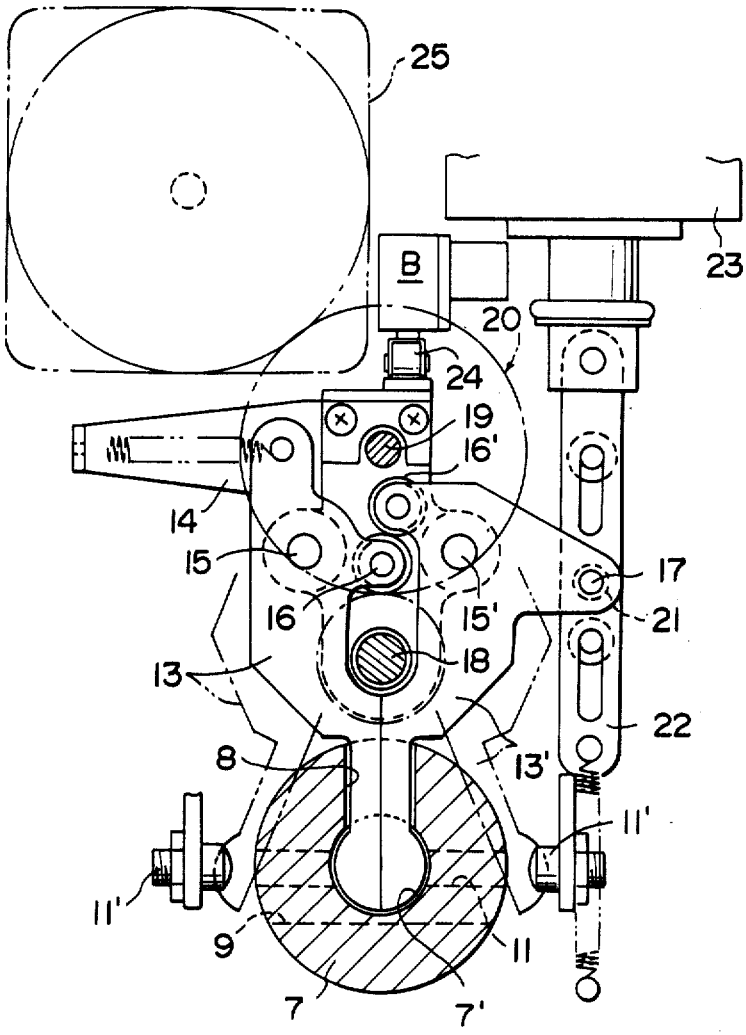
FIG. 4 is a sectional view taken along the line IV—IV of FIG. 3.

Referring now to FIG. 3, the lower movement of the shutter plates 13 and 13' which is controlled on the basis of the output signal generated from the upper photoelectric sensor 10' will be first explained.

At the beginning of the accumulation operation, in order to raise the support member 14 to its uppermost position, as shown in dot- and dash line, a reversible motor 25 is actuated to rotate the screw shaft 18 in a reverse direction. When the support member 14 reaches the uppermost position, a cam 24 mounted to the support member 14 engages with an actuator of a limit switch A to switch-off the limit switch A thereby to stop the motor 25. In the state, the shutter plates 13 and 13' are closed and supported at a level slightly lower than the top face of the recess 7'' of the coin accumulator tube 7. Coins a are successively fed by a conveyer belt 2 and the gaps therebetween are increased by the action of the high speed conveyer belt 6. The coins are then passed through the recess 7'' to be placed on the shutter plates 13 and 13'. Since the difference in height between the top face of the recess 7'' and the shutter plates 13 and 13' is small, the distance of falling movement of individual coins within the hollow cavity 7' of the tube 7 is limited. As coins a are stacked on the shutter plates 13 and 13' and the through-hole 10 is shielded by the accumulated coin pile, a signal is generated to actuate the reversible motor 25 to rotate the same in the forward direction, whereby the screw shaft 18 is rotated through the driving system 20 in the direction to lower the support member 14. The lowering speed of the support member can be controlled by detection, by the sensor 10', of the coins accumulated in the accumulator tube or by the combination of the pitch of the screw and the rotational speed of the shaft 18, so that the shutter mechanism is lowered in synchronized with the coin feeding rate. The shutter mechanism is thus lowered stepwisely or continuously while maintaining the distance between the top face of the lastly stacked coin and the top face of the recess 7'' at a small limited value. Coins a fed to the accumulator tube 7 are counted by the counting elements 4 as described before, and when the counted number reaches the pre-set number, the stopper 5 is rotated to interrupt the coin flow in the coin guide passage 1 to stop coin supply. At that time, the shutter plates 13 and 13' are lowered to the lowermost position, shown by the solid line in FIG. 3, to be aligned with the circumferential slit 9. In the meanwhile, the tube 7 may have a height such that the shutter plates 13 and 13' clear the bottom peripheral face thereof when the pre-set number of coins is stacked thereon and the shutter plates 13 and 13' reach their lowermost position. In such a case, the circumferential slit 9 may be dispensed with. Anyway, when the shutter plates 13 and 13' are lowered to the lowermost position, the cam 24 depresses the actuator of a limit switch B to stop the reversible motor 25 and the carrier bar 12 is raised beneath the shutter plates 13 and 13' to be ready for receiving the coin pile. When the lower through-hole 11 is shielded by the thus raised carrier bar 12, a signal is generated from the lower photoelectric sensor 11' for energizing the solenoid 23, whereupon the operating lever 22 is drawn or retracted by the solenoid 23 with its hole 22 receiving the operating pin 17 to swing the base portions of the shutter plates 13 and 13'. As the result of these swinging movements of the base portions, the shutter plates 13 and 13' are opened to pass the stack of coins accumulated thereon to the carrier bar 12. The coin stack is then carried by the carrier bar 12 to be moved to a wrapping station (not shown). The shutter plates 13 and 13' are kept open until the top face of the uppermost coin clears the level of the through-hole 11, since the hole 11 is shielded by the descending coin stack until then. When the coin stack clears the level of the through-hole 11, the solenoid 23 is deenergized and the operating lever 22 is returned back to the normal extended position, whereby the shutter plates 13 and 13' are swinged back to the closed position. Then, the reversible motor 25 is actuated to rotate the screw shaft 18 in the reverse direction to raise the shutter mechanism b to the uppermost position to be ready for the next cycle operation.

Although not specifically shown, the screw shaft 18 may be replaced by a rack which is meshed with a pinion rotated by a suitable motor mounted on the support member 14.

Figure 5:
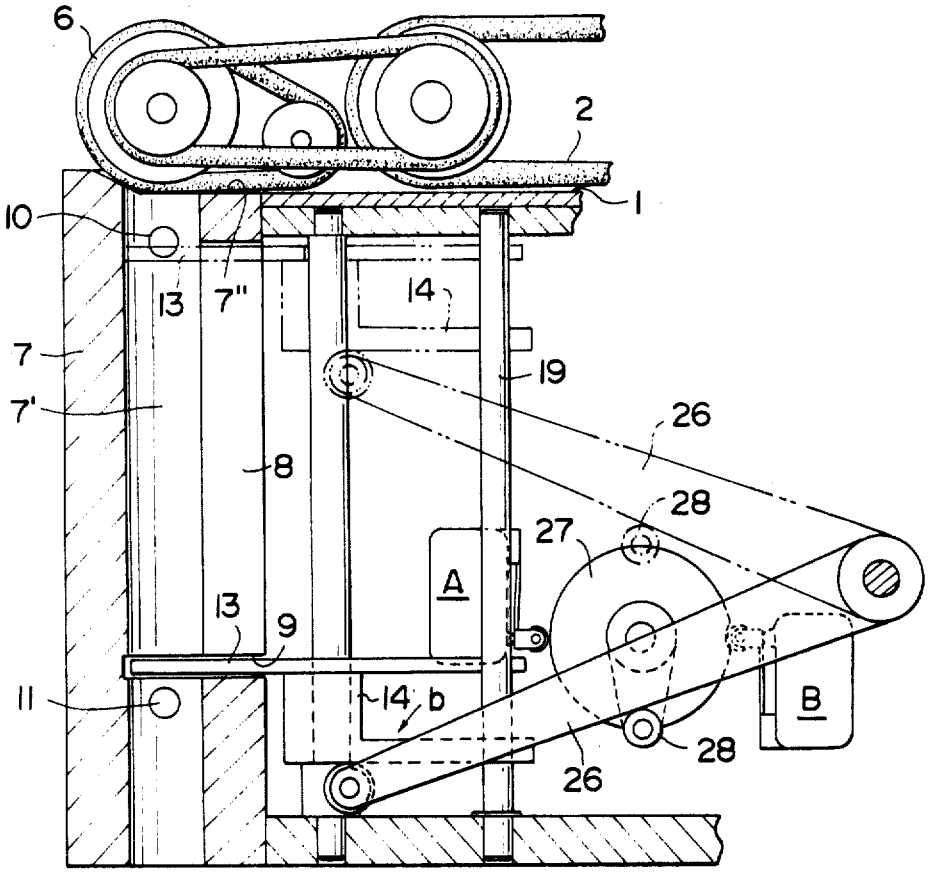
FIG. 5 is a sectional view similar to FIG. 3 but showing another embodiment of the invention.

A further modified arrangement is shown in FIG. 5, which comprises a swingable arm 26 having one end engaging with the support member 14. The arm 26 is swinged by a roller 28 mounted on a rotatable cam plate 27 to lower or raise the support member 14. The limit switches A and B are also operated by the cam plate 27 to be brought to the on or off position. There is provided means for controlling the swinging movement of the arm 26 thereby to lower the support member 14 from the uppermost position to the lowermost position at a substantially constant speed. Such means include an electric circuit for controlling the rotating speed of the motor by changing the pulse number depending on the number of counted coins, and a servo or pulse (step) motor assembled in place of the reversible motor 25.

The control of the above mentioned movable shutter mechanism b will be now explained.

As a first embodiment, the control system which is made by utilizing the outputs from the upper photoelectric sensor 10' (hereinafter referred to as an upper photo) associated with the through-hole 10 will be first explained. This control system is based on the idea that if the counted coins are detected by the upper photo, it is clear that the counted coins are stacked at least up to the position where the upper photo is located or the height of the upper photo. In such a case, the shutter plates 13 and 13' are lowered until the coins are not detected by the upper photo.

Figure 6:
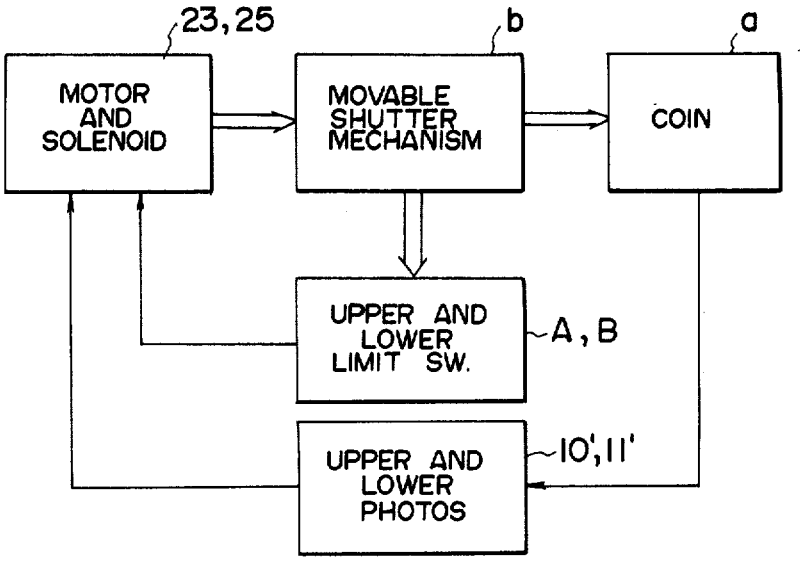
FIG. 6 is a block diagram showing a control system for controlling the operation of the embodiment shown in FIG. 1.

FIG. 6 diagrammatically shows the above-mentioned control in a block diagram. The upper and lower photos 10' and 11' are actuated by the coins a; by these photos 10' and 11', and the upper and lower limit switches A and B, the motor 25 and the solenoid 23 are electrically actuated; and by the motor 25 and the solenoid 23, the movable shutter mechanism b is mechanically actuated. In turn, by the movable shutter mechanism 6, the coin a and the upper and lower limit switches A and B are mechanically actuated.

Figure 7B:
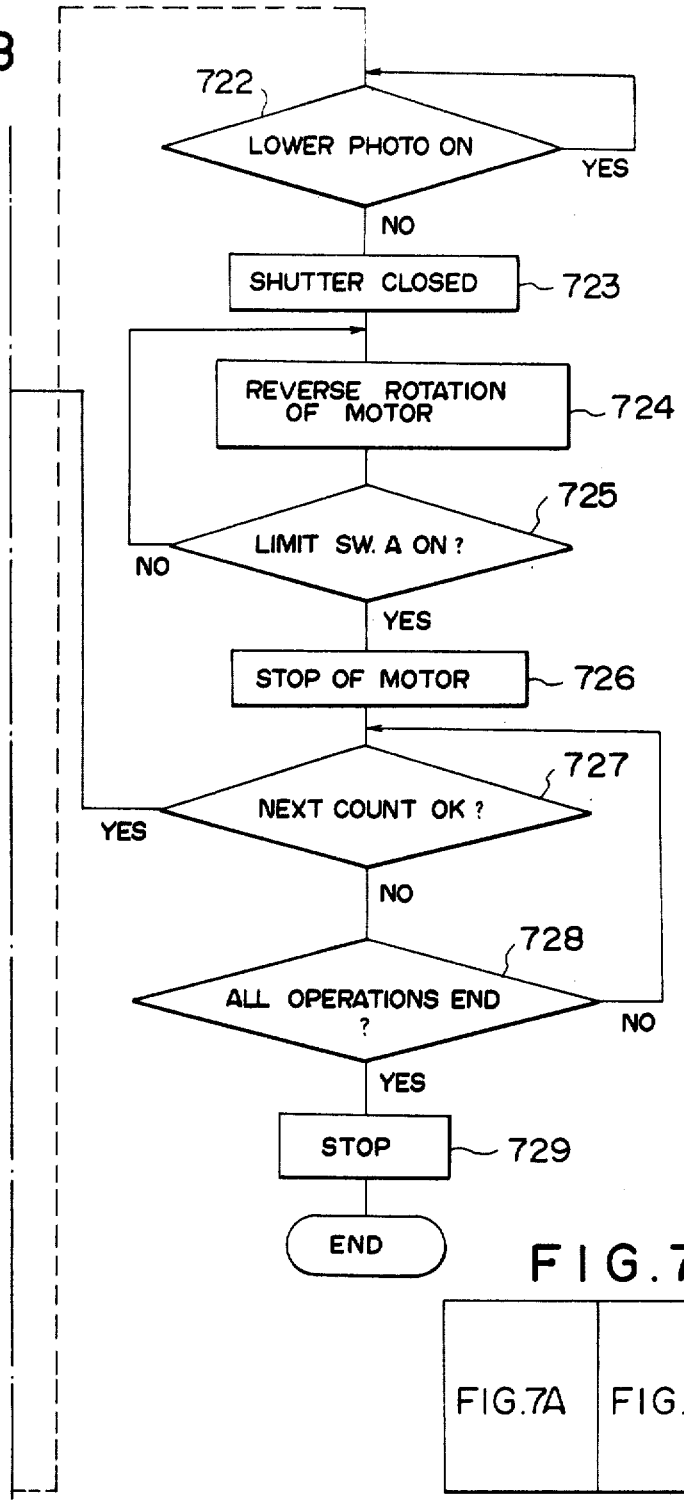
FIG. 7 shows how flow charts 7A and 7B go together to form a flow chart showing the sequential control program for controlling the embodiment shown in FIG. 1.
Figure 7:
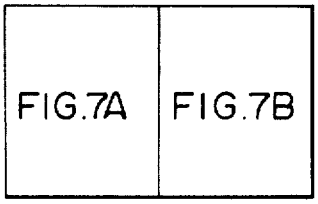
Figure 8:
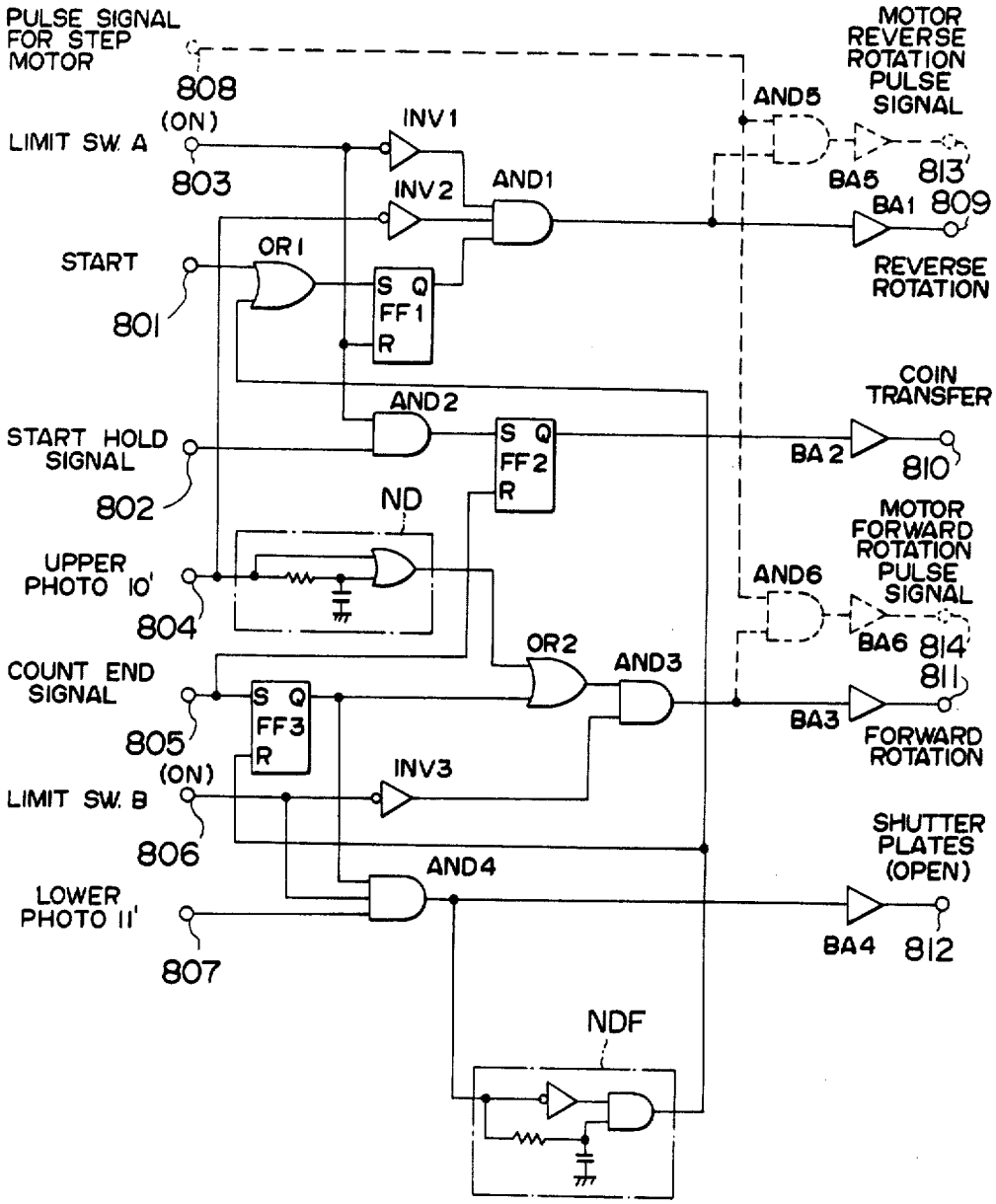
FIG. 8 is a diagram showing a control circuit associated with the embodiment shown in FIG. 1.

FIG. 7 is a flow-chart for explaining a sequence of operations of the above-mentioned control system and FIG. 8 shows its embodied circuit. The circuit of FIG. 8 will be explained with reference to the flow chart of FIG. 7.

To a terminal 801, the H level of a pulse signal is put in by a start operation (which corresponds to start 701 of the flow chart of FIG. 7; only numerals will be indicated hereinafter) and the signal is put in a set terminal S of a flip-flop FF1 through an OR gate OR1. Furthermore, the flip-flop FF1 is provided for memorizing a condition that the shutter plates 13 and 13' should be returned to their initial position. The H level signal is put out from the output terminal Q of the flip-flop FF1 and is put in an AND gate AND1. At another input terminals of the AND gate AND1, a signal which is turned to the H level when the limit switch A is turned on is put in from a terminal 803 through an inverter INV1, and in addition, a signal which is turned to the H level when the upper photo 10' detects a certain coins a is put in from a terminal 804 through an inverter INV2. For this, the output of the AND gate AND1 maintains the H level from the time when the flip-flop FF1 is set until the time when the limit switch A is turned on, and this signal of the H level output of the AND gate AND1 is given to the motor 25 as a reverse rotation signal through a buffer amplifier BA1 and a terminal 809 (702, 703 of FIG. 7) to raise the shutter plates 13 and 13' of the movable shutter mechanism b to their initial position. In such a case, if there are coins a on the shutter plates 13 and 13', the shutter plates cannot be raised to their initial position. Therefore, if any coin is detected by the upper photo 10', the output of the inverter INV2 is turned to the L level to make the output of AND gate AND1 to be at the L level, for safety.

When the shutter plates 13 and 13' are raised to the initial position, the limit switch is turned on and, therefore an H level signal is put in at a terminal 803. This H level signal causes the output of the reverse rotation signal (put out from the terminal 809) to be stopped and at the same time resets the flip-flop FF1 since the signal is put in at a reset terminal R of the flip-flop FF1 (703, 704 of FIG. 7). Furthermore, the signal which is put in at the terminal 803 is also put in an AND gate AND2 at one terminal thereof and at the other terminal, a start hold signal is put in. This start hold signal is one which is maintained to be at an H level from the time when the start operation (701 of FIG. 7) is made to the time when the operation is ended, for example, by a stop operation or an actuation of an automatic stop mechanism due to detection of nonpresence of coins (728, 729 of FIG. 7). The output of the AND gate AND2 is put in at a set terminal of a flip-flop FF2, and the output from the output Q of the flip-flop FF2 is fed as a coin transfer signal to a motor, not shown, for driving the conveyor belt 2, through a buffer amplifier BA2 from a terminal 810. Consequently, as soon as the shutter plates 13 and 13' return to their initial position, the flip-flop FF2 is caused to be set to start the transfer of the coins (705 of FIG. 7). Furthermore, at the reset terminal R of the flip-flop FF2, a count end signal which is turned to the H level when the coins a reaches predetermined number (or wrapping number) is put in from a terminal 805 and the flip-flop FF2 is reset so as to stop the transfer of the coins a at the time of the count end.

In a meanwhile, attendent on the transfer and accumulation of the coins, the coins a are detected by the upper photo 10'. The detection signal of the upper photo 10' is put in an AND gate AND3 through a fall edge delay circuit ND and an OR gate OR2. At the other input terminal of the OR gate OR2, the signal from the output terminal Q of a flip-flop FF3 is put in the flip-flop FF3 puts out its H level signal when the count end signal put in from the terminal 805 is put in at the set terminal of the flip-flop FF3 and puts out its L level signal when a shutter plate closing signal, hereinafter described, is put in at the reset terminal R of the flip-flop FF3. Furthermore, at the other input terminal of the aforementioned AND gate AND3, a signal which is turned to the H level when the limit switch B for detecting the shutter plates 13 and 13' being lowered up to their open position is turned on, is put in through an inverter INV3 through from a terminal 806. The output of the aforementioned AND gate AND3 is fed to the motor 25 as a forward rotation signal through a buffer amplifier BA3 from a terminal 811.

When the coin a is detected by the upper photo 10', an H level singal is put in at the fall edge delay circuit ND (706 of FIG. 7). This H level signal is put in the AND gate AND3 through the OR gate OR2. In a meanwhile, since the counting operation has been just started, the flip-flop FF3 is maintained to be reset and since the shutter plates 13 and 13' is not in the open position, an L level signal is supplied to the terminal 806. This L level signal is put in the AND gate AND3 as a H level signal through the inverter INV3. For this, an H level signal is put out from the AND gate AND3 to issue the forward rotation signal from the terminal 811 (707 of FIG. 7).

While the coins a are successively transferred, counted and accumulated, the detection signals by the upper photo 10' are intermittently put out at a very short interval. For this, if the forward rotation signals put out from the terminal 811 are intermittently put out at a very short interval, such intermittent output are not suitable for the motor 25. In order to avoid these intermittent outputs, the fall edge delay circuit ND is provided for absorbing the intermittent condition and putting out a smoothed or continuous forward rotation signal as a whole. Consequently, when the coins a are successively accumulated and detected by the upper photo 10', the motor 25 is caused to continue its forward rotation and if the coins a are intermittently detected beyond a predetermined interval, the motor 25 is caused to be stopped at each time of detection (708, 709, 710 of FIG. 7).

Thus, mainly, the motor 25 is controlled by the detection signals of the upper photo 10' until the shutter plates 13 and 13' reach their open position to make the limit switch on and thereby putting the L level signal from the inverter INV3 in the AND gate AND3. In other words, in case where the coins a are successively accumulated, before the shutter plates 13 and 13' reach the open position, the count operation is ended. At the time, the H level of the count end signal is put in from the terminal 805 at the reset terminal R of the flip-flop FF2 and the set terminal S of the flip-flop FF3. The resetting of the flip-flop FF2 causes the transfer of the coins a to be stopped (712, 713 of FIG. 7). On the other hand, the flip-flop FF3 is caused to be set. The flip-flop FF3 is provided for automatically lowering the shutter plates 13 and 13' up to the open position, regardless of the condition of the detection signal of the upper photo 10' in case where the count operation is ended before the shutter plates 13 and 13' reach the open position. When the flip-flop FF3 is set, the H level signal is fed from its output terminal Q to the AND gate AND3 through the OR gate OR2 to continue to put out the forward rotation signal until the limit switch B is turned on.

On the other hand, in case where the coins a are intermittently accumulated, there is a possibility that the shutter plates 13 and 13' reach the open position before the end of count. In such a case, the limit switch B is turned on and an H level signal is put in from the terminal 806, inverted into a L level signal through the inverter INV3 and then put in the AND gate AND3. Consequently, thereafter the forward rotational signal is not put out from the terminal 811 (711, 717 of FIG. 7). In this state, the shutter plates 13 and 13' are stand-by until the count end and at the time of the count end, the transfer of the coins a is stopped in a similar manner mentioned above (718, 719 of FIG. 7).

In either case of the above, at the time when the coin count is ended, a signal for starting a wrapping operation is put out by a conventional control, not shown. Then, the carrier bar 12 starts to be upwardly moved toward the shutter plates 13 and 13' up to just below the same in order to receive the coins a accumulated in the tube 7 and transfer the same to a wrapping mechanism, not shown. When the carrier bar 12 is moved just below the shutter plate 13 and 13' in open position, the shutter plates 13 and 13' are opened to transfer the accumulated coins a onto the carrier bar 12. More particularly, when the lower photo 11' detects the carrier bar 12 and the transferred coins a to put out a detection signal, the detection signal is put in an AND gate AND4 from an terminal 807. At the other terminals of the AND gate AND4, the signal from the output terminal Q of the flip-flop FF3 and the detection signal from the limit signal B are put in. Then, the output signal of the AND gate AND4 is put out as a shutter plate open signal to the solenoid 23 through buffer amplifier BA4 from a terminal 812 and simultaneously put in a fall edge detection circuit NDF. This fall edge detection circuit NDF puts out an H level pulse signal by detecting the time when an input signal is fallen from H level to L level and the output signal is fed to the OR gate 1 and the reset terminal R of the flip-flop FF3 as a shutter closing signal showing that the shutter plate open signal is not put out from the terminal 812.

Under a condition that the count end signal is put out, that is, the H level signal is put out from the output terminal Q of the flip-flop FF3, and when the limit switch B is on, as the carrier bar 12 is detected by the lower photo 11', the H level signal is put out from the AND gate AND4 to be fed as the shutter plate open signal to the solenoid 23 from the terminal 812 (720, 721 of FIG. 7). Thus, the accumulated coins a are dropped on the carrier bar 12 from the shutter plates 13 and 13'. Thereafter, when the carrier bar 12 is started to be lowered so as to transfer the coins a to the wrapping mechanism, not shown, the lower plate 11' continues to detect the carrier bar 12 and the accumulated coins. When the carrier bar 12 is further lowered and then the accumulated coins a are not detected, since the H level signal is put in at the terminal 807, the H level of the shutter plate open signal is not put out from the terminal 812 (722, 723 of FIG. 7). For this, due to deenergization of the solenoid 23, the shutter plates 13 and 13' are closed by an action of the spring.

On the other hand, when the shutter plate open signal is not put out, the H level of pulse signal is put in the set terminal S of the flip-flop FF1 and the reset terminal R of the flip-flop FF3 from the fall edge detection circuit NDF. Then, when the flip-flop FF1 is set, the shutter plates 13 and 13' are actuated to be returned to the initial position (724–726 of FIG. 7) in a similar manner to initial operations at the starting time (701–704 of FIG. 7). Furthermore, by the resetting of the flip-flop FF3, the forward rotation signal is inhibited not to be put out to the motor 25 from the terminal 811 even when the shutter plates 13 and 13' are moved from the open position.

Furthermore, when all operations for the coin a are ended, the H level of the start hold signal which has been supplied to the terminal 802 is reset (727–729 of FIG. 7).

Moreover, in case where a step motion or a pulse motor may be used as the motor 25 in order to perform a reliable position control of the shutter plates 13 and 13', the outputs of the AND gates AND1 and AND3 may be put in AND gate AND5 and AND6, respectively, and at the other input terminals of the AND gates AND5 and AND6, the pulse signal may be put in from the terminal 808, as shown in dotted lines of FIG. 8. Each output of two AND gates AND5 and AND6 may be fed to the motor as the reverse rotation signal or the forward rotation signal through each buffer amplifier BA5, BA6 from each terminal 813, 814.

As a second embodiment, the control system which utilizes the outputs of the counter elements 4 provided for counting the number of the coins a will be explained. This control system is based on the idea that from the counted number of the coins a counted by the counting elements 4, the accumulated height of the coins a accumulated in the tube can be calculated since a specific kind of the coins to be counted is preset and, therefore, the thickness of the one coin can be found. In the case, the shutter plates 13 and 13' are lowered in accordance with the accumulated height of the coins a corresponding to the number of the accumulated coins a.

Figure 9:
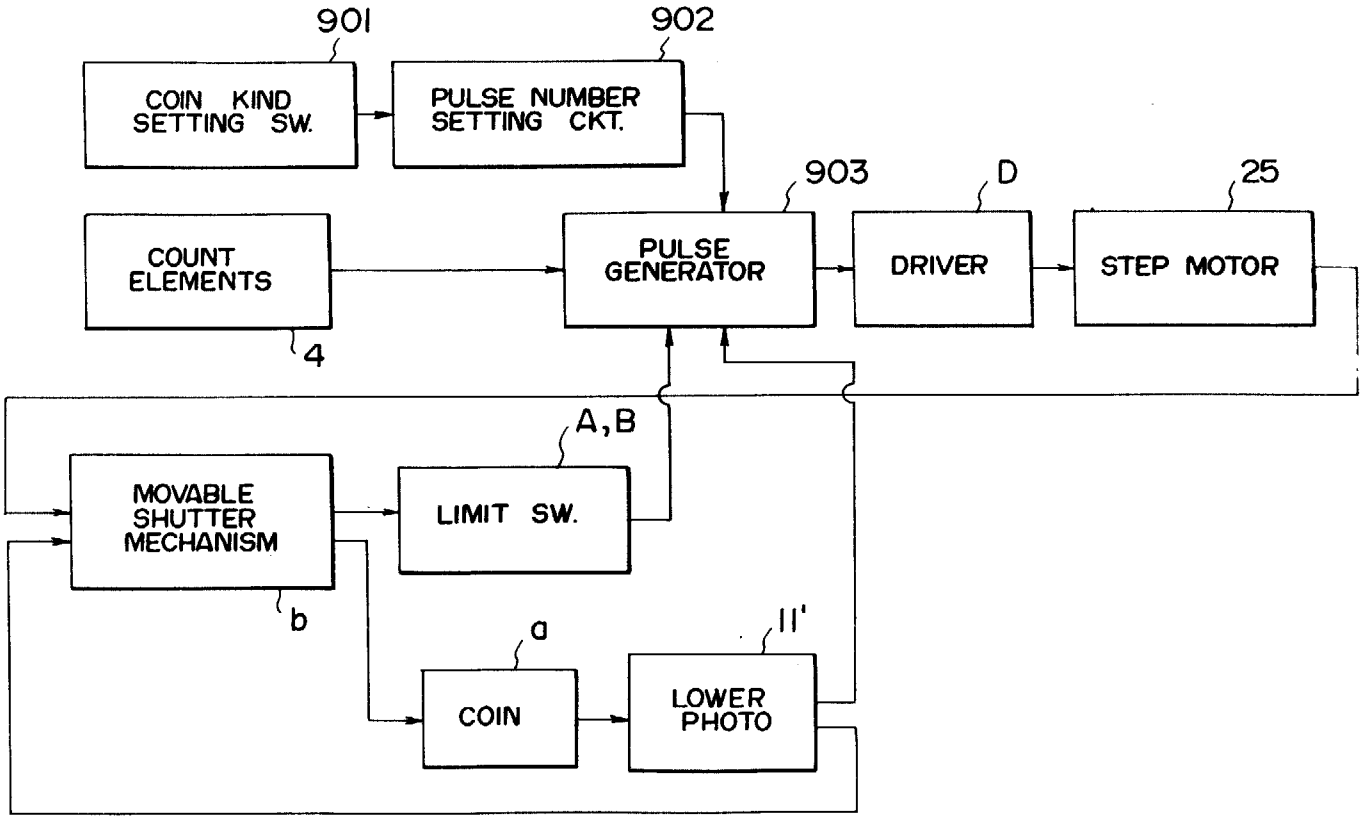
FIG. 9 is a block diagram showing another control system.

FIG. 9 diagrammatically shows the above-mentioned control in a block diagram. The coin kind signal which is issued from a coin kind setting switch 901 associated with coin kind setting means, such as a dial or a button switch, not shown for selecting a specific kind of coins to be counted, is put in a pulse member setting circuit 902. The pulse number setting circuit 902 determines a pulse number per one number of coin corresponding to the selected kind of the coins and feeds a pulse number signal to a pulse generator 902. The pulse generator 903 feeds pulses per one number of coin to the step motor 25 through a driver D each time when it receives a count pulse from count elements 4. Then, the movable shutter mechanism b is driven by the step motor 25. Consequently, the shutter plates 13 and 13' are caused to be lowered by the height corresponding to the number of the accumulated coins a. Furthermore, the pulse generator 903 is operated by the limit switches A and B which are actuated by the movable shutter mechanism b, and the lower photo 11' for detecting the transfer of the accumulated coins a by the carrier bar 12 so as to move the shutter plates 13 and 13' to the initial position or the open position.

Figures 10, 10B:
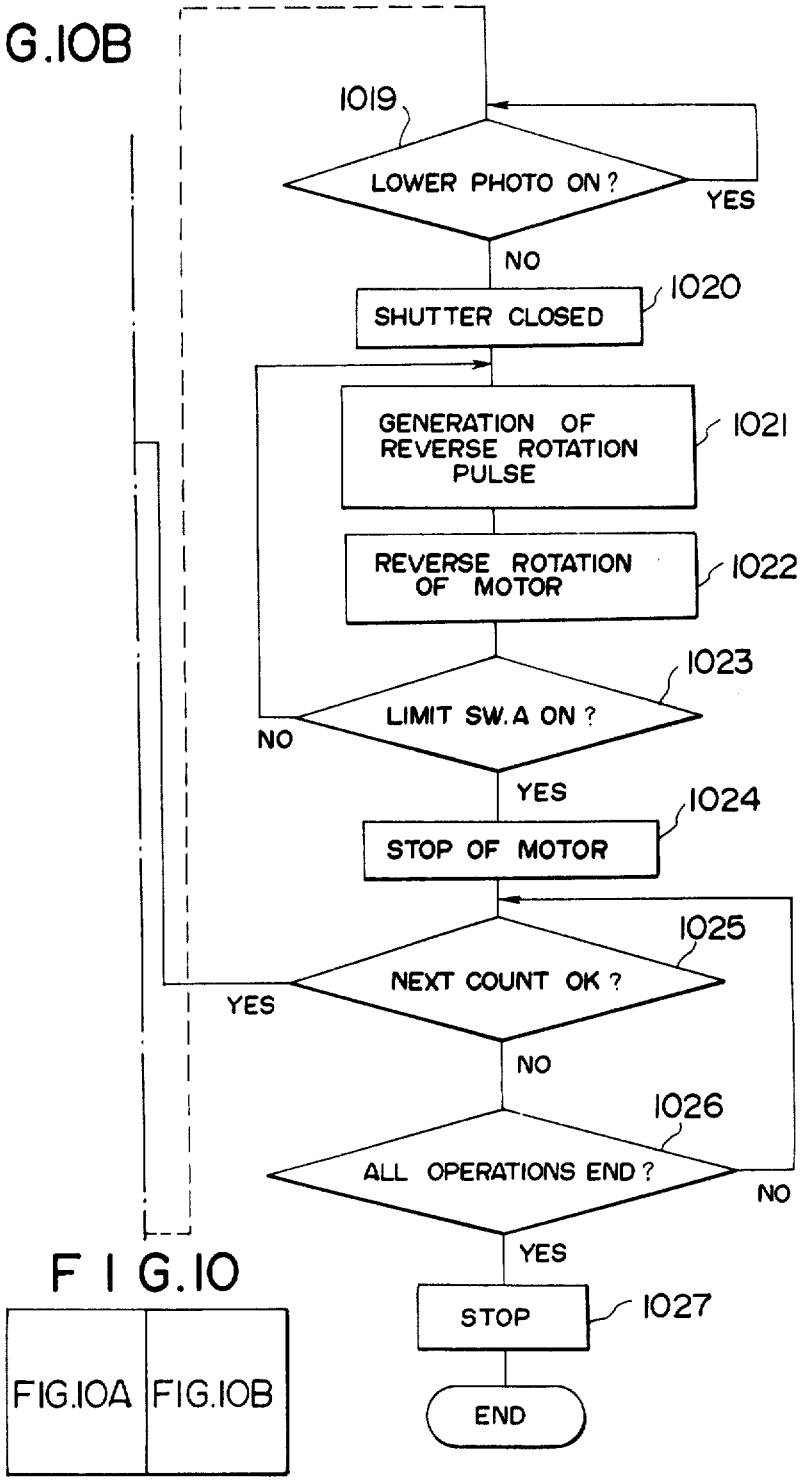
FIG. 10 shows how flow charts 10A and 10B go together to form a flow chart showing the sequential control program in accordance with the block diagram of FIG. 9.
Figure 11:
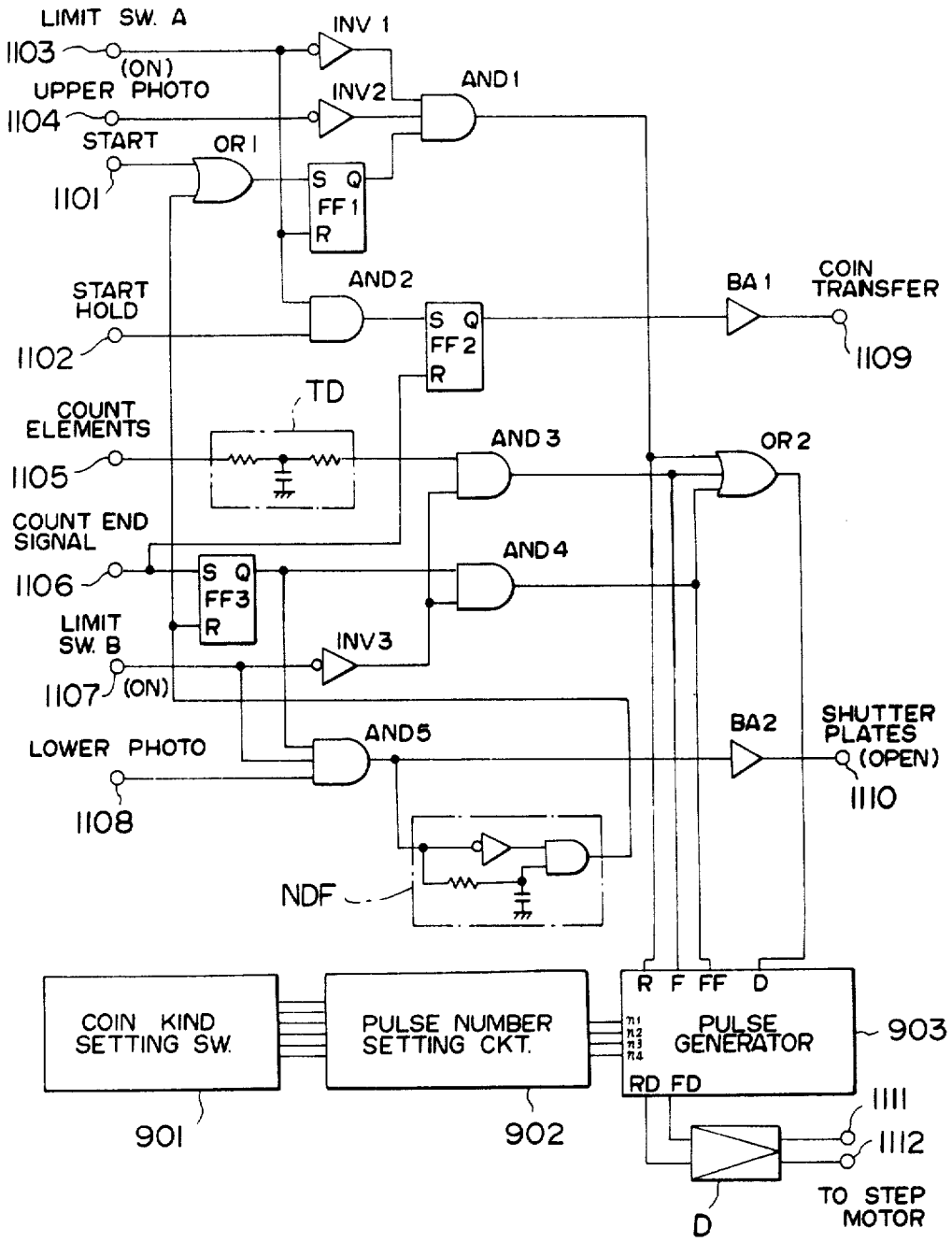
FIG. 11 is a diagram showing a control circuit for instructing the sequential control operations shown in FIG. 10.

FIG. 10 is a flow-chart from explaining a sequence of operations of the above control system and FIG. 11 shows its embodied circuit. Since the main portions of the circuit elements shown in FIG. 11 are similar to these of FIG. 8, the different points will be explained mainly.

Relationship among the coin kind setting switch 901, the pulse number setting circuit 902 and the pulse generator 903 is mentioned above, and in the illustrated embodiment, there are six kinds of coins and four kinds of coin thickness (the pulse numbers $n_1$, $n_2$, $n_3$, $n_4$). The pulse generator 903 receives four pulse number signals representative of the coin thicknesses at its terminals $n_1$, $n_2$, $n_3$ and $n_4$. The pulse generator 903 also receives the reverse rotation signal put out from the AND gate AND1 at its terminal R, receives a coin signal put out from the AND gate AND3 at its terminal F, and receives the forward rotation signal put out from the AND gate AND4. In addition, the pulse generator 903 further receives a drive signal put out from the OR gate OR2 when either one of these reverse rotation signal, coin signal and forward rotation signal are put in the OR gate OR2. In accordance with combination of the above-mentioned input signals, the pulse generator 903 feeds a reverse rotation drive signal from its terminal RD or a forward rotation drive signal from its terminal FD, respectively, through the driver D from a terminal 1111 or 1112.

The reverse rotation signal put out from the AND gate AND1 is put out in a similar manner to that of the first embodiment, and similarly the coin transfer signal put out from a terminal 1109 and the shutter plate open signal put out from a terminal 1110 are also constructed in a similar manner to those of the first embodiment. That is, the pulse signal by the start operation, the start hold signal, the signal by ON operation of the limit switch A, the detection signal of the upper photo 10', the count end signal, the signal by ON operation of the limit switches 13, and the detection signal of the lower photo 11' are put in at terminals 1101, 1102, 1103, 1104, 1106, 1107 and 1108, respectively. From each terminals, these signals are put in a group of gates constructed in a similar manner to those of the first embodiments. Therefore, detailed explanations on functions of the gates will be omitted.

In case where the lowering of the shutter plates 13 and 13' is controlled by the number of the coins a, the count is always ended before the shutter plates 13 and 13' reach the open position. Therefore it is necessary to drive the step motor 25 until the shutter plates 13 and 13' reaches the open position. Then, the drive by the count elements and the drive after the count end must be controlled, which will be explained.

At the terminal 1105, the coin count signal from the count elements 4 is put in, and this signal is fed to the AND gate AND3 at one terminal thereof through the delay circuit TD. Furthermore, the delay circuit TD is provided in view of the transfer period of the coins from count element position to accumulator tube position. At the other terminal of the AND gate AND3, the signal by ON operation of the limit switch B which is put in from the terminal 1107 is put in through the inverter INV3 and while the coin count signal is put in the AND gate AND3, the limit switch B is usually not actuated. Therefore, as mentioned above, each coin signal per each coin is put in at the terminal F of the pulse generator 903 from the AND gate AND3 and the drive signal is put in at the terminal D of the pulse generator 903 through the OR gate OR2 so as to issue a predetermined pulse number (either one of $n_1$, $n_2$, $n_3$ and $n_4$) of the forward rotation drive signal per each coin from the terminal FD (1008–1011 of FIG. 10).

The output terminal Q of the flip-flop FF3 which memorizes the count end condition by receiving the count end signal from the terminal 1106 is connected to one input terminal of the AND gate AND4, and at the other input terminal, the signal by ON operation of the limit switch B is put in through the inverter INV3 from the terminal 806. Consequently, when a predetermined number of the coins a, the flip-flop FF3 is set and, thereby the forward rotation signal for moving the shutter plates 13 and 13' to the open position is put in at the terminal FF of the pulse generator 903 from the AND gate AND4. The pulse generator 903 continues to put out the forward rotation drive signal from the terminal FD until the forward rotation signal put in from the terminal FF disappears. Thus, the step motor 25 is actuated to move the shutter plates 13 and 13' to the open position (1011–1016 of FIG. 10).

The second embodiment can allow the fall distance of each coin in the accumulator tube to be maintained to be a minimum, comparing with the first embodiment.

What is claimed is:

1. A coin accumulator assembly for use in a coin wrapping machine, comprising a coin accumulator tube, a shutter movably inserted into said coin accumulator tube for supporting coins stacked in the accumulator tube until a predetermined number of coins is accumulated and for opening to pass coins for a further treatment when said predetermined number of coins is accumulated in said coin accumulator tube, and means for stepwisely lowering said shutter, wherein said coin accumulator tube has a vertically-extending slit and a circumferential slit formed at the lower portion of the tube, and said shutter includes substantially symmetrical shutter plates each having a generally semicircular free end, an elongated stem portion and a generally trapezoidal base portion, said shutter plates being closed during the counting and accumulating operation with their free ends snugly received in the cavity of said coin accumulator tube to form the bottom of the tube and with their stem portion extending through said vertically-extending slit.

2. A coin accumulator assembly as claimed in claim 1, wherein said means for stepwisely lowering said shutter includes a support member for supporting said base portions of said shutter plates and having a threaded hole, a screw shaft thrusted through said threaded hole of said support member, a driving system including a reversible motor for rotating said screw shaft, and a guide rod to be slidably engaged with said support member for preventing the support member from being rotated but for guiding the support member in the downward direction when said screw shaft is rotated.

3. A coin accumulator assembly as claimed in claim 1, wherein said means for stepwisely lowering said shutter includes a support member for supporting said base portions of said shutter plates, a pinion mounted to said support member, a motor mounted on said support member for driving said pinion, and a rack meshing with said pinion and extending in the vertical direction to guide said support member in the downward direction.

4. A coin accumulator assembly as claimed in claim 1, wherein said means for stepwisely lowering said shutter includes a support member for supporting said base portions of said shutter plates, a swingable arm having one end engaged with said support member, a cam plate engaging with said swingable arm, and means for rotating said cam plate.

* * * * *